US007143551B2

(12) United States Patent
Corwin

(10) Patent No.: US 7,143,551 B2
(45) Date of Patent: Dec. 5, 2006

(54) VENTED INSULATED BUILDING

(76) Inventor: Thomas N. Corwin, 3713 Five Mile Rd., Traverse City, MI (US) 49686

( * ) Notice: Subject to any disclaimer, the term of this patent is extended or adjusted under 35 U.S.C. 154(b) by 141 days.

(21) Appl. No.: 10/621,905

(22) Filed: Jul. 17, 2003

(65) Prior Publication Data

US 2005/0011141 A1 Jan. 20, 2005

(51) Int. Cl.
*E04B 7/00* (2006.01)
*E04D 3/40* (2006.01)
*E04D 13/00* (2006.01)

(52) U.S. Cl. ..... 52/95; 52/94; 52/199; 454/260; 454/354

(58) Field of Classification Search ..... 52/302.1, 52/408, 508, 281, 95, 94, 371, 96, 302.3, 52/302.6, 198–200; 454/199, 358, 365–368, 454/35, 254, 256, 258, 260, 275, 276, 354
See application file for complete search history.

(56) References Cited

U.S. PATENT DOCUMENTS 2,645,824 A * 7/1953 Titsworth ..... 52/302.3
3,174,421 A * 3/1965 Gray ..... 454/260
3,204,379 A * 9/1965 Osborn ..... 52/302.6
4,016,323 A * 4/1977 Volovsek ..... 442/374
4,126,973 A * 11/1978 Luckey ..... 52/94
4,195,455 A * 4/1980 Chalmers et al. ..... 52/94
4,201,121 A * 5/1980 Brandenburg, Jr. ..... 454/250
4,589,239 A * 5/1986 Cummings ..... 52/200
4,658,552 A * 4/1987 Mulford ..... 52/94
4,702,149 A 10/1987 Speer
4,986,039 A * 1/1991 Weisner ..... 52/72
5,125,207 A * 6/1992 Strobl et al. ..... 52/747.1
5,213,542 A * 5/1993 Kelly ..... 454/357
5,238,450 A * 8/1993 Rotter ..... 454/260
5,335,462 A * 8/1994 Park ..... 52/95
5,349,796 A * 9/1994 Meyerson ..... 52/309.11
5,370,577 A * 12/1994 Jonett et al. ..... 454/260
5,384,994 A * 1/1995 Borba ..... 52/261
5,561,952 A * 10/1996 Damron ..... 52/198
5,640,812 A * 6/1997 Crowley et al. ..... 52/90.1
5,718,086 A * 2/1998 Dunn ..... 52/95
5,740,636 A * 4/1998 Archard ..... 52/94
5,765,324 A * 6/1998 Schultz ..... 52/200
5,826,383 A * 10/1998 Garrison ..... 52/198
5,848,512 A * 12/1998 Conn ..... 52/729.1
5,937,592 A * 8/1999 Tamlyn ..... 52/95
5,996,289 A * 12/1999 Allaster ..... 52/95
6,036,102 A * 3/2000 Pearson ..... 236/49.3

(Continued)

*Primary Examiner*—Carl D. Friedman
*Assistant Examiner*—Yvonne M. Horton
(74) *Attorney, Agent, or Firm*—Price, Heneveld, Cooper, DeWitt & Litton, LLP

(57) ABSTRACT

An improved building structure that eliminates condensation at exterior building walls, thereby preventing mold growth and avoiding the damage, environmental degradation and health problems associated with mold growth includes enveloping spaces that allow natural convection of air in exterior wall structures and roof structures. An embodiment of the building structure includes an exterior wall structure defining an air gap between insulation and exterior sheathing, a roof structure defining an air gap between thermal insulation and a roof deck, the wall air gap and roof air gap being in fluid communication, a roof vent to allow air to flow to an outside space, and an air ventilation grid at the lower end of the wall air gap. The air ventilation grid includes openings that allow air to freely enter the wall air gap and flow upwardly by natural convection into the roof air gap and out of the roof vent.

1 Claim, 6 Drawing Sheets

U.S. PATENT DOCUMENTS 6,052,956 A * 4/2000 Hoy et al. ..... 52/200
6,079,167 A * 6/2000 Voegele, Jr. ..... 52/200
6,195,948 B1 * 3/2001 Lamanna ..... 52/200
6,220,956 B1 * 4/2001 Kilian et al. ..... 454/239
6,346,040 B1 * 2/2002 Best ..... 454/260
6,355,333 B1 3/2002 Waggoner et al.
6,401,412 B1 * 6/2002 Cooper ..... 52/302.1
6,440,365 B1 8/2002 Poye et al.
6,679,010 B1 * 1/2004 Honda ..... 52/95
6,705,052 B1 * 3/2004 Larson ..... 52/95
6,718,699 B1 * 4/2004 Larson ..... 52/95
6,745,531 B1 * 6/2004 Egan ..... 52/302.1

* cited by examiner

VENTED INSULATED BUILDING

FIELD OF THE INVENTION

This invention relates to building construction, and more particularly to insulated buildings having improved wall and roof ventilation that eliminate and/or substantially reduce problems associated with condensation at exterior wall surfaces, including growth of mold and mildew, problems associated with ice dam formation, and problems associated with accumulation of off-gas pollutants such as from carpeting, paints and other building materials.

BACKGROUND OF THE INVENTION

A problem with conventional building construction, especially residential buildings, is that moisture tends to condense in the space between the exterior sheathing and the interior wall. This can occur whenever the surfaces of the exterior sheathing are at or below the dew point temperature of the air between the exterior sheathing and the interior wall. It is believed that the improved air tight sealing techniques currently used in the building construction industry reduce the air exchange rate both within the living space of the building and within spaces between exterior sheathing and interior walls. While the improved air tightness of modern buildings results in energy savings, and lower heating and air conditioning costs, condensation between exterior sheathing and interior walls can promote the growth of biological pollutants such as mold, mildew and bacteria.

As is evident from recent publications and events, the proliferation of litigation, insurance claims and consumer concern relating to health issues associated with mold and other biological pollutants have attracted the attention of the residential construction industry. However, current efforts to eliminate and/or reduce mold growth in buildings have focused on preventing water infiltration such as through basement walls, detecting and eliminating plumbing leaks, exhausting air from showers, baths, kitchens, and other moisture generating areas to the outside of the building, and automating dehumidification and/or regulation of air exchange rates based on relative humidity in the living space. These efforts provide beneficial results. However, they do not eliminate or significantly reduce the potential for condensation between exterior sheathing and interior walls. Regulating conditions within the interior living spaces of a building does not prevent air trapped between exterior sheathing and interior walls from contacting surfaces at or below the dew point temperature of the trapped air, and therefore does not prevent condensation on these cool surfaces. Such condensation can facilitate mold growth since mold spores are relatively ubiquitous and can thrive in many wet or damp environments provided they have an adequate food source. Unfortunately, many building materials contain organic materials that molds may use as a source of food. For example, molds can grow on wood products, paper, wallboard and painted surfaces if there is adequate moisture. It is generally well accepted that the only practical way of preventing mold growth in buildings is to prevent water leaks and condensation from accumulating on building materials and/or other materials that can provide nourishment to the molds, since it is practically impossible to prevent the microscopic mold spores from contacting building materials and/or eliminate food sources from building materials.

Elimination of mold growth in buildings is extremely important. Even relatively small amounts of mold can release toxic chemicals that cause dry coughs, runny noise, rashes and fatigue. Sensitive individuals may experience more serious health problems, such as headache, nosebleed, dizziness, allergic reactions, asthma and/or other respiratory problems. High levels of mold contamination can cause very serious chronic and acute health problems such as neurological disorders, brain damage, autonomic dysfunction, hypotension and/or cancer. Accordingly, building techniques and structures that prevent condensation while achieving good energy efficiency are needed.

Another problem that frequently occurs in residential buildings, especially in the vicinity of a sky light or roof window, is the formation of ice dams. Ice dams can form on sloped roofs down slope of a hot spot on the roof. Heat from a hot spot on the roof can cause snow to temporarily melt and re-solidify at a down slope colder spot on the roof, thereby forming an ice dam which can cause water to pool up slope of the ice dam. Roofs are typically designed to shed water by allowing it to cascade down the sloped roof from one roof tile to an adjacent roof tile until it falls off the edge of a roof, such as into a gutter or directly onto the ground. However, sloped residential roofs are not typically watertight. As a result, any standing water, such as a pool of water adjacent an ice dam, can leak under and between roof tiles into the building causing damage and/or promoting mold growth. Hot spots on a roof can develop where air stagnates between the roof deck and an underlying ceiling panel. Such hot spots often occur adjacent skylights. Typically, a skylight is installed on and between rafters. The installed skylight blocks natural convection in the space defined between the rafters. This causes the air between the rafters to become stagnated and overheated, thereby allowing formation of ice dams and resulting water damage. One technique that has been used to eliminate this problem is to drill holes through the rafters to allow air to flow around the skylight. However, this results in weakening of the structure and is extremely labor intensive. Therefore, there is a need for improved building techniques and structures that allow free convection around skylights.

A further problem with current building construction techniques is that they tend to allow toxic volatile organic compounds (VOCs) that are off-gassed from construction materials, such as flooring, paints, varnishes, cabinets, etc., to accumulate in living spaces and in spaces between exterior sheathing and interior walls. Toxic pollutants may continue to off-gas from various building materials for several years after they have been installed. Accumulation of these off-gassed VOCs in stagnate air between exterior sheathing and interior wall panels may significantly extend this period thereby increasing health risks. Accordingly, there is a need for improved construction techniques and building structures that enhance natural convection in the spaces between exterior sheathing and interior wall panels of buildings in order to minimize undesirable health risks associated with toxic compounds off-gassed from building materials.

SUMMARY OF THE INVENTION

The invention provides improved building construction techniques and building structures that eliminate or substantially reduce condensation at exterior building walls, thereby preventing conditions that would promote mold growth, and thereby avoiding the resulting damage, environmental degradation and health problems associated with mold growth. The improved building construction techniques and structures of this invention also help prevent accumulation of toxic volatile organic compounds off-gassed from building materials within spaces between exterior sheathing and interior walls of buildings, thus minimizing health problems associated with these toxic compounds.

In accordance with an aspect of this invention, a building having enveloping air spaces that allow natural convection of air in exterior wall structures and roof structures is provided. The building includes an exterior wall structure having an exterior sheathing, an interior wall, and at least one layer of thermal insulation material between the exterior sheathing the interior wall. The layer of thermal insulation material is spaced away from the exterior sheathing to provide a wall air gap between the insulation and the exterior sheathing. The building also includes a roof structure having a roof deck, an interior ceiling, and a layer of thermal insulation material between the roof deck and interior ceiling. The layer of thermal insulation material is spaced away from the roof deck to provide a roof air gap between the layer of thermal insulation material and the roof deck. The structure also includes a roof vent to allow air to flow freely from the roof air gap to an outside space. The building structure is configured so that the wall air gap is in fluid communication with the roof air gap. An air ventilation grid is located at the lower end of the wall air gap. The air ventilation grid has a plurality of openings that are sufficiently small to prevent insects from entering the wall air gap, but sufficiently large to allow outside air to freely enter into the wall air gap, whereby air is allowed to freely flow by natural convection upward from the outside through the ventilation grid, upwardly through the wall air gap, upwardly along the roof air gap, and out the roof vent. The structure eliminates stagnation of air within spaces defined between exterior building surfaces and interior building surfaces, thereby eliminating or very substantially reducing moisture condensation within these spaces.

In accordance with another aspect of the invention, there is provided a building that includes a roof structure having a plurality of rafters, a roof deck attached over the rafters, an interior ceiling below the rafters, and a layer of thermal insulation material between the roof deck and interior ceiling. The layer of thermal insulation material is spaced away from the roof deck to provide an air gap between the layer of thermal insulation and the roof deck. The building also includes a roof vent that allows air to flow from the roof air gap to an outside of the building. The structure further includes a skylight mounted on and between rafters, wherein the rafters on which the skylight is mounted are comprised of plastic members having a plurality of openings that allow air to flow freely from space between the rafters on which the skylight is mounted to adjacent spaces defined by other rafters and through the roof vent to the outside of the building.

These and other features, advantages and objects of the present invention will be further understood and appreciated by those skilled in the art by reference to the appended drawings, and following specification and claims.

DESCRIPTION OF THE PREFERRED EMBODIMENTS

Figure 1:
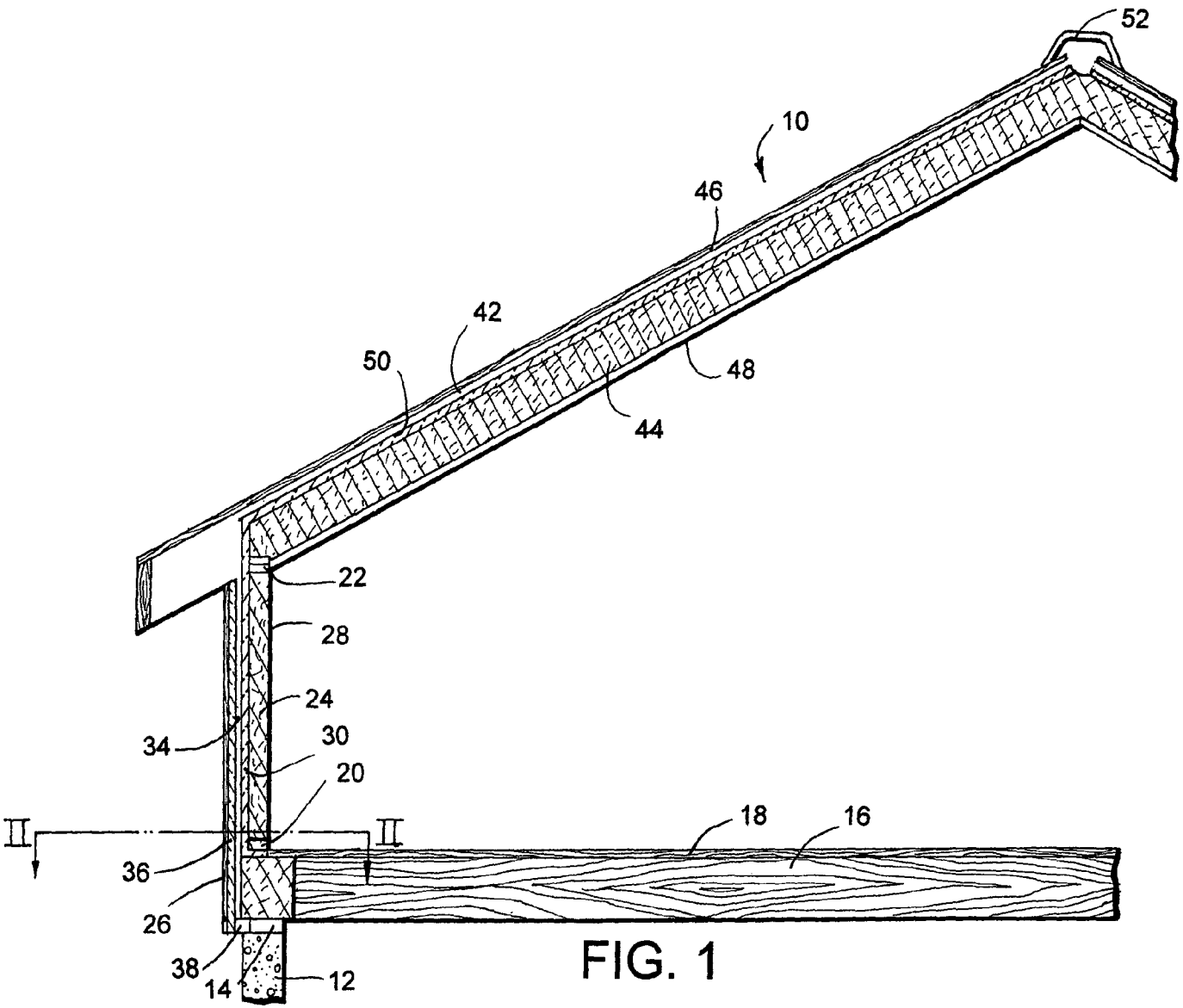
FIG. 1 is a schematic cross-sectional view of a building structure in accordance with the invention.

Shown in FIG. 1 is a schematic cross-sectional illustration of a building constructed in accordance with an aspect of the invention. Illustrated building 10 is constructed on a conventional foundation 12. Typically, lumber is fastened along the upper surface of the foundation 12 to form a continuous sill plate 14 onto which floor joists 16 are fastened in generally uniformly spaced apart parallel relationship. Plywood, orientated strand board, or other suitable panels are fastened over floor joists 16 to provide a floor deck 18. The building may be framed with lumber in a conventional manner with 2×4 bottom plates 20, 2×4 top plates 22 and 2×6 vertical studs 24.

Figure 2:
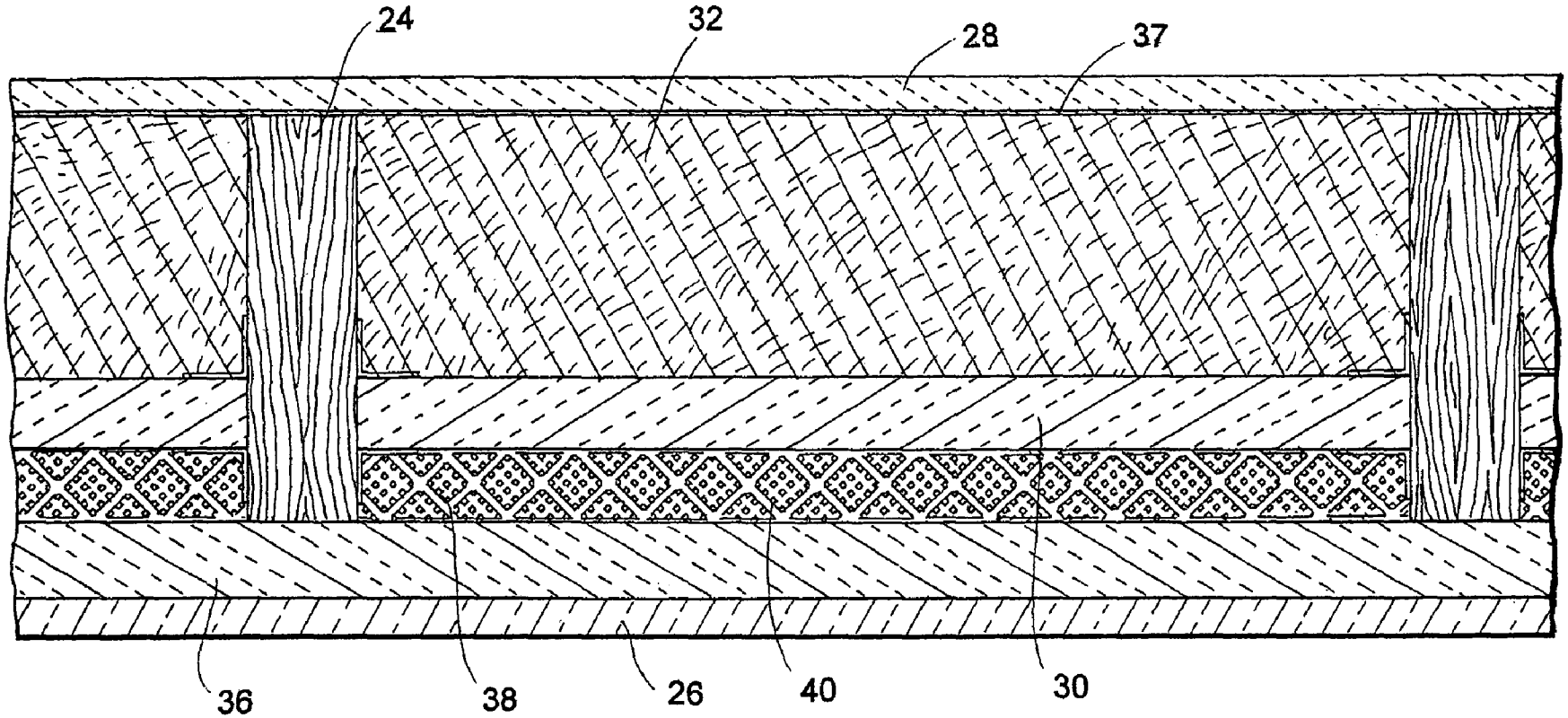
FIG. 2 is a transverse section of a wall of the building shown in FIG. 1 as seen along view lines II—II.

As is more easily seen in FIG. 2, insulation is disposed between exterior sheathing 36 and interior wall panel 28. Exterior facade material 26 is layered over exterior sheathing 36. In the illustrated embodiment, the insulation material comprises a one-inch polystyrene foam thermal insulation panel 30 having a thermal insulation value of R-5, and 3½ inches of dimensionally stable glass fiber thermal insulation 32 having a thermal insulation value of R-13. The thermal insulation material is disposed adjacent interior wall panel 28 and is spaced away from exterior sheathing 36 to provide an air gap 34 (see FIG. 1) between thermal insulation 30 and 32 (see FIG. 2), and exterior sheathing 36. Air gap 34 (FIG. 1) is typically about 1 inch thick. In the embodiment illustrated in FIGS. 1 and 2, exterior sheathing 36 is comprised of a layer of one-inch polystyrene insulation which further reduces the possibility of condensation formation and enhances thermal efficiency to reduce heating and air conditioning costs. Other types of rigid thermal insulation, oriented strand board, plywood, or other suitable materials may be used instead of polystyrene insulation 36. A thin moisture/air barrier membrane or film 37, such as polyolefin film (e.g., polyethylene or polypropylene) or polyester film (e.g., polyethylene terephthalate) may be installed between the interior wall 28 and insulation 32. In order to allow air to enter from the outside into air gap 34 while preventing insects from entering the air gap, an air ventilation grid 38 is located at a lower end of air gap 34 (also referred to as the "wall air gap"). Air ventilation grid 38 includes a plurality of apertures or openings 40 that are sufficiently small to prevent insects from entering the wall air gap, but sufficiently large to allow outside air to freely enter into wall air gap 34. A suitable aperture size that prevents most insects from being able to enter air gap 34 but which allows air to freely flow into air gap 34 is about 1/16 inch. Slightly larger or slightly smaller openings 40 may be used. However, when the opening is too large (e.g., about 1/8 inch or larger) insects can enter air gap 34, potentially leading to an infestation. On the other hand, openings much smaller than about 1/16 inch are generally not necessary, and are more difficult to manufacture.

The building in accordance with an aspect of this invention also includes a roof structure defining a roof air gap 42 in fluid communication with wall air gap 34. Roof air gap 42 is typically about 1 inch thick. As is conventional, rafters 44 are supported on top plates 22 of the building frame, and a roof deck, typically comprised of plywood, oriented strand board or the like, is fastened to rafters 44. Fastened to the underside of rafters 44 are interior ceiling panels (e.g., drywall, wood planks, etc.) that form interior ceiling 48.

Also attached to rafters 44 is a layer 50 of thermal insulation material (e.g., one-inch thick rigid polystyrene foam having an insulation value of R-5). Layer 50 of roof insulation material is spaced from roof deck 46 to form roof air gap 42. A conventional ridge vent 52 is provided to allow air to exhaust by natural convection from roof air gap 42.

As can be seen by reference to FIG. 1, building 10 is designed and constructed so that wall air gap 34 is in fluid communication with roof air gap 42 whereby air may flow from the outside into wall air gap 34 through air ventilation grid 38, upwardly and into roof air gap 42, along roof air gap 42 to the crest of the roof, and out of ridge vent 52 by natural convection. The relatively slow but constant circulation of air through the wall air gap 34 and roof air gap 42 reduces and/or eliminates the possibility of humid air being trapped between the interior wall and the exterior sheathing and condensing on surfaces of the exterior wall structure that are at or below the dew point of the air, thus eliminating or at least substantially reducing the possibility of creating an environment capable of facilitating sustained mold growth. The building structure also prevents accumulation of toxic volatile organic compounds within the exterior wall structure, thereby reducing risks associated with exposure to these pollutants.

Figure 3:
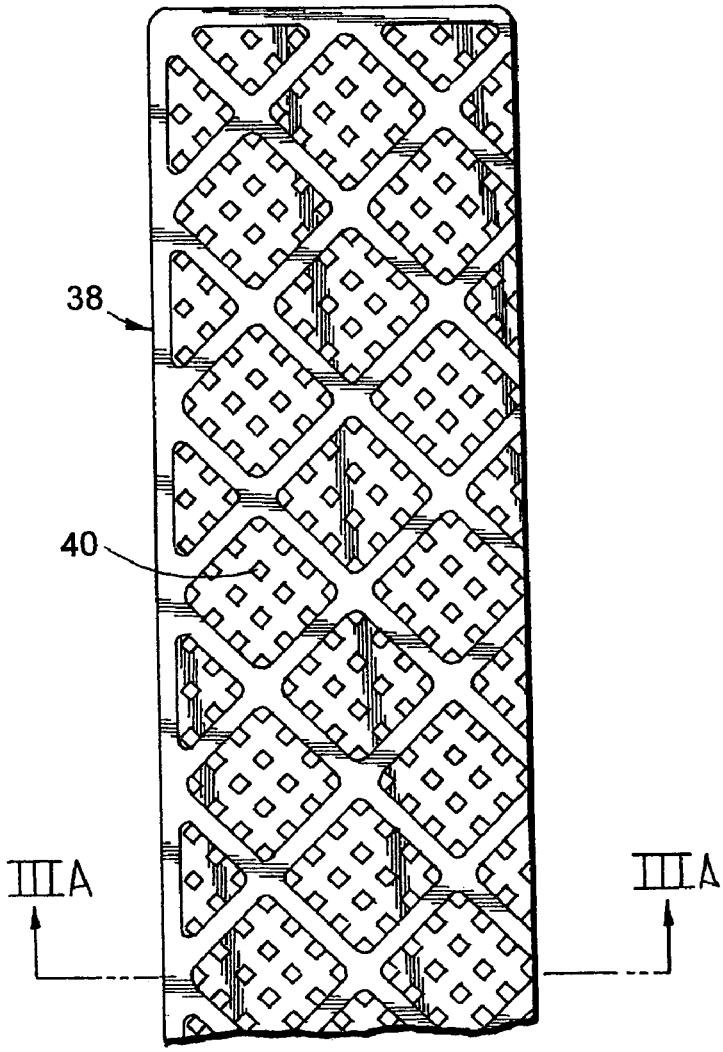
FIG. 3 is a top plan view of an air ventilation grid utilized in the building structure of the invention, illustrating details thereof.
Figure 3A:
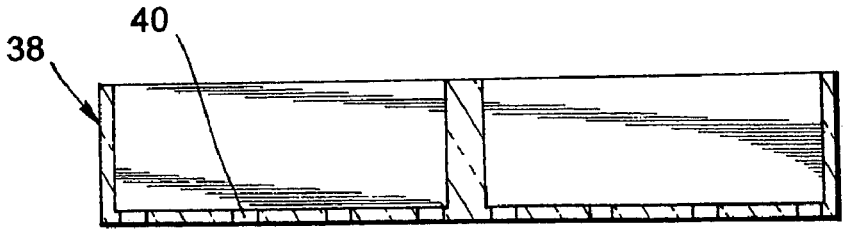
FIG. 3A is a transverse sectional view of the air ventilation grid shown in FIG. 3, as viewed along lines IIIA—IIIA.

Wall and ceiling insulation panels 30 and 50 may be secured to studs 24 and rafters 44 respectively by any suitable means. However, a suitable and preferred technique involves use of a plastic fastener or bracket such as that described in copending U.S. patent application Ser. No. 10/007,863. Glass fiber insulation 32 (FIG. 2) may be deposited into the space between foam insulation panel 30 and interior wall 28 by any suitable means, such as blowing or pouring loose fiber material into the space defined between foam insulation panel 30 and interior wall 28 after foam insulation panel 30 has been attached to studs 24. Exterior facade 26 may comprise generally any conventional exterior material, including wood siding, vinyl siding, aluminum siding, brick, etc. Interior wall panel 28 and interior ceiling 48 may also be comprised of any suitable interior wall material, including dry wall, wood paneling, etc. Air ventilation grid 38, shown in greater detail in FIG. 3, is a molded plastic part having sufficient strength to act as a structural member equivalent to a similarly sized piece of lumber for the roof application.

Figure 4:
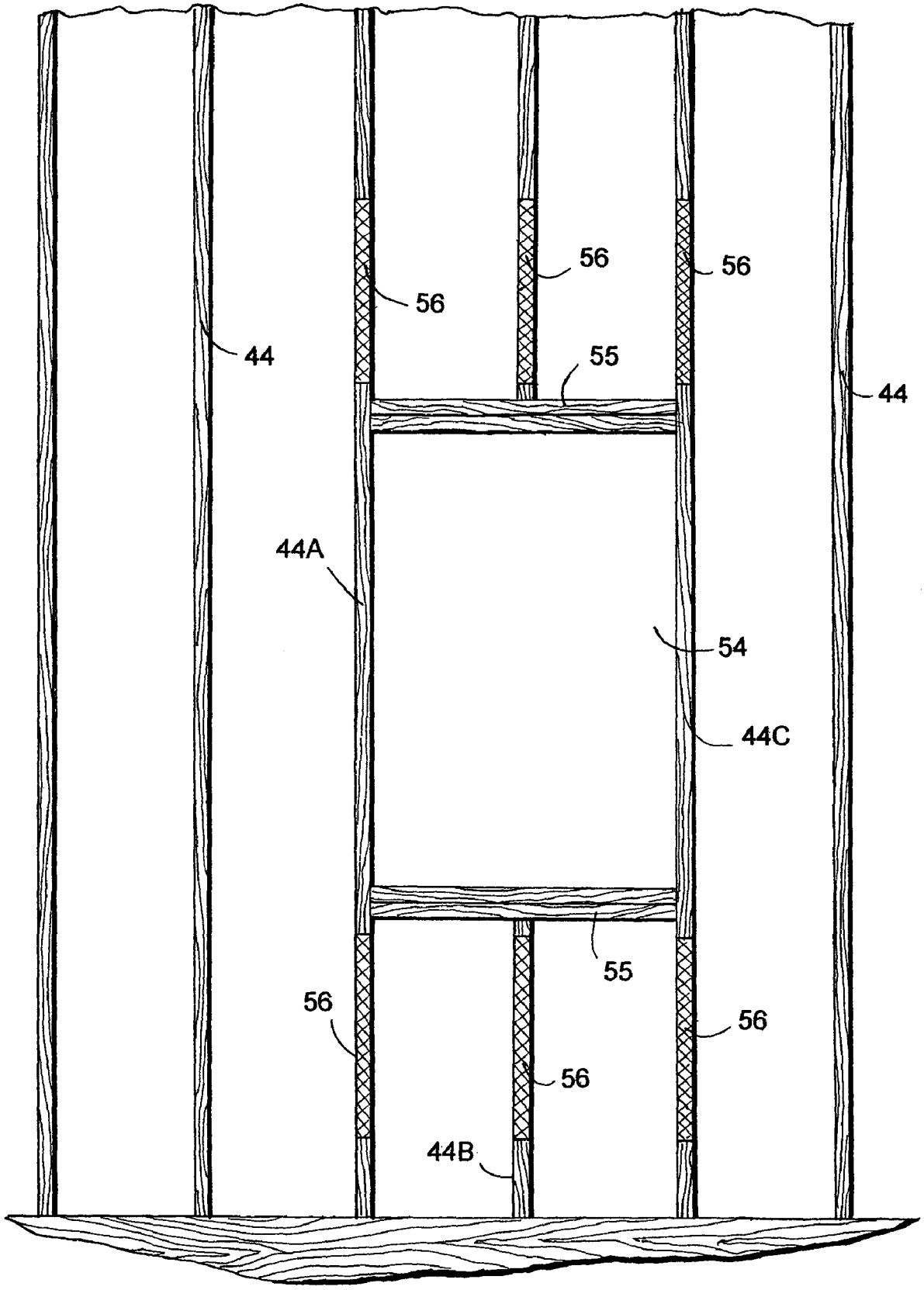
FIG. 4 is a top plan view of a skylight installed in a roof in accordance with an aspect of the invention.
Figure 5:
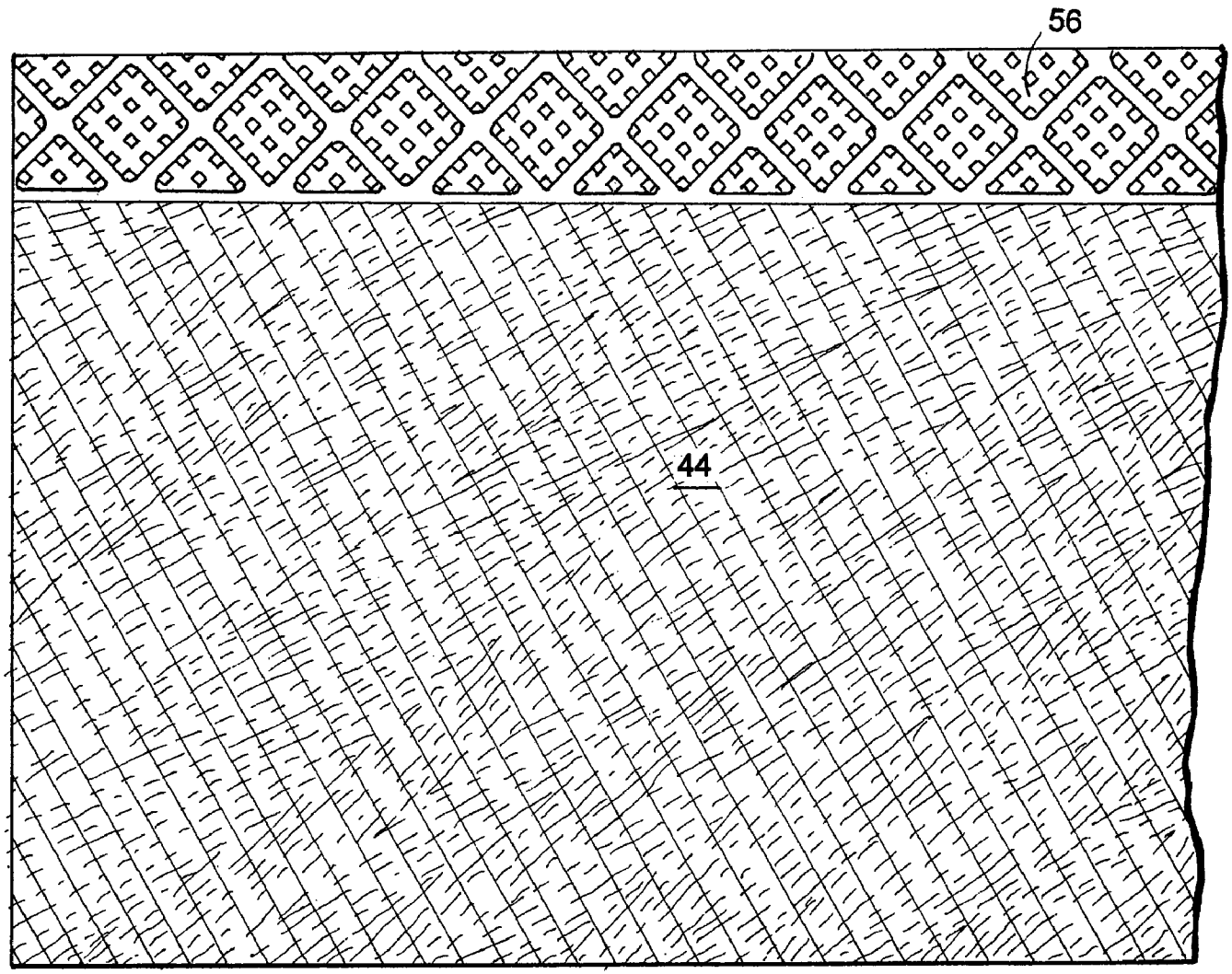
FIG. 5 is an elevational view of a portion of the structure shown in FIG. 4, as seen along view lines V—V.

As shown in FIGS. 4 and 5, a skylight 54 is installed in the roof between rafters 44A and 44C, with a section of rafter 44B located between rafters 44A and 44C removed to accommodate skylight 54. Transverse structural members 55 are used to frame skylight 54 and redistribute structural loads around skylight 54. As illustrated in FIG. 5, at least a portion (e.g., an upper portion as shown in the drawing) of rafters 44A, 44B and 44C are replaced with a ventilation grid 56 that is designed to have sufficient structural strength at least equivalent to the original rafter, while allowing air to flow through openings 40 (FIG. 3). Ventilation grid 56 may be substantially the same as or identical to air ventilation grid 38. Preferably, ventilation grid 56 is designed in such a way that it may be fastened, such as with screws, to rafters 44A, 44B and 44C. Preferably, ventilation grids 56 are located on at least a few feet of rafters 44A, 44B and 44C on both the down slope and up slope sides of skylight 54, whereby air may horizontally flow freely through spaces defined between rafters 44A and 44B and between 44B and 44C to prevent stagnation, hot spots, and damage associated with ice dam formation. Ventilation grid 56 may also be used on rafters where there is need of horizontal ventilation, such as at valleys.

Figure 6:
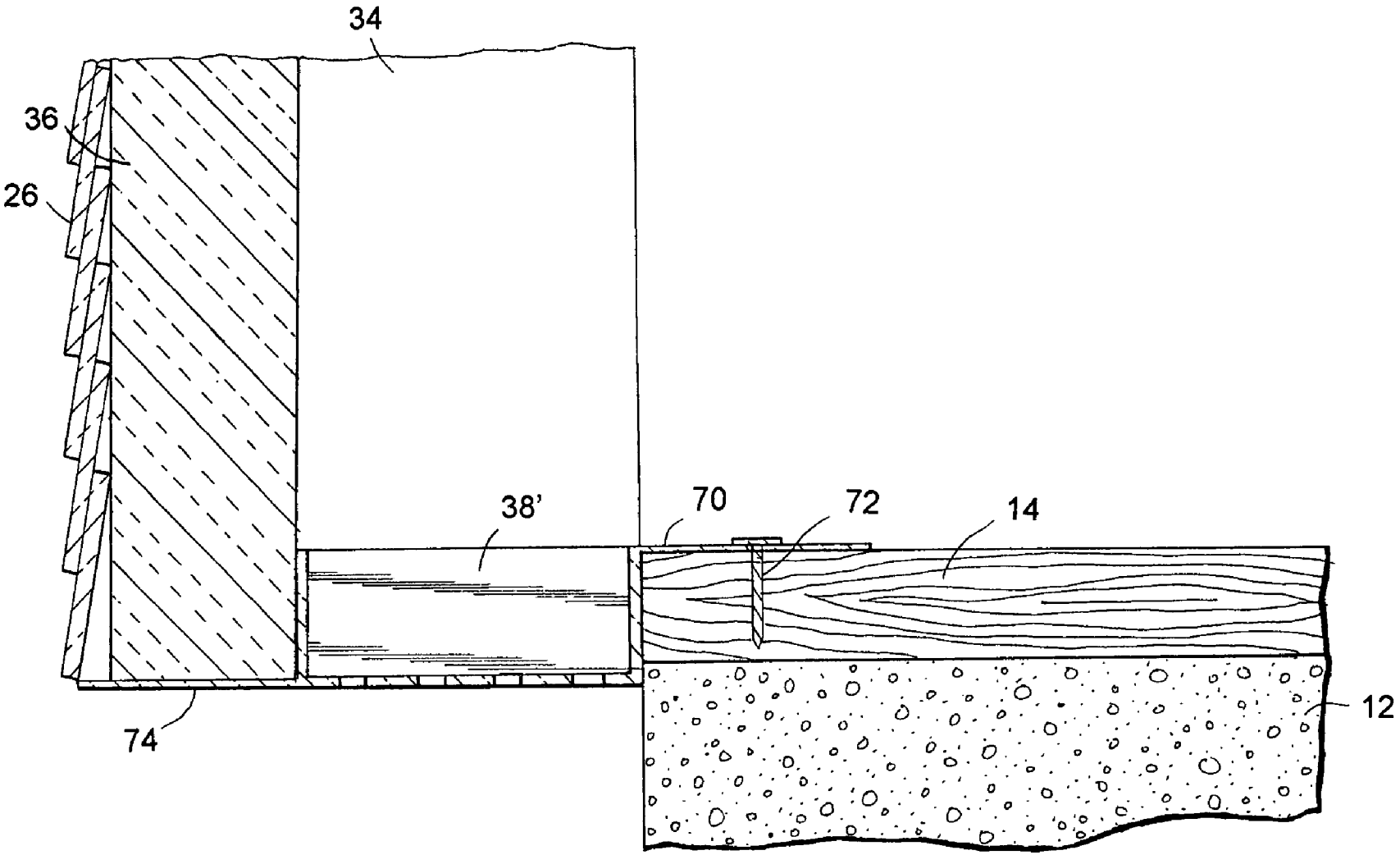
FIG. 6 is a schematic cross-sectional view of a building structure in accordance with the invention employing an air ventilation grid in accordance with an alternative embodiment.

In an alternative preferred embodiment, air ventilation grid 38' may be of a lighter weight design than air ventilation grid 56, since grid 38 is not a load bearing member, whereas grid 56 is intended to function as a load bearing member that helps support the building roof. In the embodiment shown in FIG. 6, air ventilation grid 38' includes an attachment flange 70 that projects horizontally from an interior side of grid 38' to facilitate attachment of grid 38' to sill plate 14 with a fastener 72 (e.g., a nail or screw), and a support flange 74 that projects horizontally from an exterior side (opposite the interior side) of grid 38' to act as a supporting ledge for exterior sheathing 36 and exterior facade material 26 (e.g., siding). In the illustrated embodiment, flange 70 is flush with the upper edge of grid 38' and flange 74 is flush with the lower edge of grid 38'. This arrangement is believed to best facilitate rapid construction, and may also have manufacturing and shipping advantages (e.g., better nesting characteristics).

The above description is considered that of the preferred embodiments only. Modifications of the invention will occur to those skilled in the art and to those who make or use the invention. Therefore, it is understood that the embodiments described above are merely for illustrative purposes and are not intended to limit the scope of the invention, which is defined by the following claims as interpreted according to the principles of patent law, including the doctrine of equivalents.

The invention claimed is:

1. A building comprising:

a roof structure including a plurality of rafters, a roof deck attached over the rafters, an interior ceiling below the rafters, a layer of thermal insulation material between the roof deck and the interior ceiling, the layer of thermal insulation being spaced away from the roof deck to provide an air gap between the layer of thermal insulation material and the roof deck;

a roof vent that allows air to flow from the roof air gap to outside of the building; and a skylight mounted on and between two rafters, the rafters on which the skylight is mounted being comprised of plastic members having a plurality of openings that allow air to horizontally flow freely from space between the rafters on which the skylight is mounted to adjacent space defined by rafters and through the roof vent to outside of the building.

* * * * *